US006626601B1

(12) United States Patent
Moor et al.

(10) Patent No.: US 6,626,601 B1
(45) Date of Patent: Sep. 30, 2003

(54) STORAGE POUCH HAVING ATTACHMENT LOOPS

(75) Inventors: Marc L. Moor, Oakwood, OH (US); Jeffrey T. DeBord, Worthington, OH (US); Diana W. Juratovac, Columbus, OH (US)

(73) Assignee: MeadWestvaco Corporation, Stamford, CT (US)

( * ) Notice: Subject to any disclaimer, the term of this patent is extended or adjusted under 35 U.S.C. 154(b) by 155 days.

(21) Appl. No.: 09/687,018

(22) Filed: Oct. 13, 2000

(51) Int. Cl.[7] ..... B42F 13/00

(52) U.S. Cl. ..... 402/73; 150/108; 206/472; 281/15.1; 281/27.1; 383/40; 383/97; 402/79; 402/80 R; D3/300; D19/33

(58) Field of Search ..... 402/73, 79, 80 R, 402/8, 80 P, 502; 281/15.1, 19.2, 21.1, 27.1, 45; 150/107, 108, 109; D19/33; 206/472, 473; 383/40, 97, 117, 119; D3/300; 53/570

(56) References Cited

U.S. PATENT DOCUMENTS

| | | | | | |
|---|---|---|---|---|---|
| D98,250 | S | * | 1/1936 | Hassenfeld | D3/206 |
| D98,251 | S | * | 1/1936 | Hassenfeld | D3/206 |
| D129,750 | S | * | 9/1941 | Blake | 150/108 |
| 2,677,376 | A | * | 5/1954 | Brunner | |
| 2,717,015 | A | | 9/1955 | Berry | 150/34 |
| 2,762,503 | A | * | 9/1956 | Steinthal | 206/472 |
| 3,982,687 | A | * | 9/1976 | Auer et al. | 383/14 |
| 4,149,738 | A | * | 4/1979 | Illos et al. | 283/72 |
| 4,580,667 | A | | 4/1986 | Herwood | 190/110 |
| 4,754,790 | A | | 7/1988 | Meyers | 150/104 |
| 5,133,607 | A | * | 7/1992 | Bonke | 220/495.11 |
| 5,197,525 | A | | 3/1993 | Cantor | 150/102 |
| 5,366,070 | A | | 11/1994 | Wolov | 206/214 |
| 5,417,456 | A | | 5/1995 | Laubacher | 281/45 |
| 5,695,233 | A | | 12/1997 | Feldman | 294/138 |
| 5,738,460 | A | | 4/1998 | Flynn | 402/73 |
| RE35,814 | E | * | 6/1998 | Olson | 15/227 |
| 5,829,502 | A | | 11/1998 | Distefano et al. | 150/113 |
| D413,753 | S | * | 9/1999 | Allsop | D6/626 |
| 6,019,539 | A | | 2/2000 | Lynton | 402/79 |
| 6,053,381 | A | * | 4/2000 | Fahl et al. | 150/108 |
| 6,079,528 | A | | 6/2000 | Moor | 190/126 |
| 6,174,082 | B1 | * | 1/2001 | Pelky et al. | 150/114 |
| 6,179,025 | B1 | * | 1/2001 | Sutton | 150/105 |
| 6,257,472 | B1 | * | 7/2001 | Freedman | 150/108 |
| D451,273 | S | * | 12/2001 | Moor et al. | D3/206 |
| D453,876 | S | * | 2/2002 | Moor et al. | D3/300 |
| 6,508,391 | B2 | * | 1/2003 | Gilbert | 224/664 |
| 2002/0029831 | A1 | * | 3/2002 | Pendergrass | 150/105 |

FOREIGN PATENT DOCUMENTS

| | | |
|---|---|---|
| DE | 19732403 | * 12/1998 |

* cited by examiner

*Primary Examiner*—Monica Carter
(74) *Attorney, Agent, or Firm*—Thompson Hine LLP

(57) ABSTRACT

A storage pouch has a pouch body and a cord. The pouch body encloses an interior cavity and has an opening in communication with the interior cavity. The cord is attached to the pouch body and has variable-size first and second loops located outside the pouch body, wherein increasing the size of the first loop decreases the size of the second loop, and wherein increasing the size of the second loop decreases the size of the first loop. The loops are made of substantially equal size to attach the storage pouch by the loops to the rings of a loose-leaf ring binder, and the size of one loop is enlarged to hang the storage pouch by the one loop on a larger hook.

25 Claims, 6 Drawing Sheets

STORAGE POUCH HAVING ATTACHMENT LOOPS

BACKGROUND OF THE INVENTION

The present invention relates generally to storage pouches, and more particularly to a storage pouch having attachment loops.

One conventional storage pouch includes a flexible sheet protector. The flexible sheet protector has a transparent compartment to hold a piece of paper. The flexible sheet protector also has three holes along one edge allowing the sheet protector to be installed in the rings of a standard loose-leaf ring binder. Another conventional storage pouch includes a blueprint carrier having a sheet protector. The sheet protector has a transparent compartment to hold a blueprint. The sheet protector also has holes along an edge for installation of the sheet protector in the rings of a loose-leaf ring binder.

What is needed is a storage pouch which provides for more versatility in holding different objects and in attaching the storage pouch to other objects.

SUMMARY OF THE INVENTION

A first expression of a preferred embodiment of the invention is for a storage pouch having a pouch body and a cord. The pouch body encloses an interior cavity and has an opening in communication with the interior cavity. The cord is attached to the pouch body and has variable-size first and second loops located outside the pouch body. Increasing the size of the first loop decreases the size of the second loop, and increasing the size of the second loop decreases the size of the first loop.

A second expression of a preferred embodiment of the invention is for a storage pouch having a pouch body and a cord. The pouch body has a substantially textbook size and shape, encloses an interior cavity, and has an opening in communication with the interior cavity. The cord is attached to the pouch body and has variable-size first and second loops which are located outside the pouch body and which are spaced apart a distance so as to be attachable, respectively, to first and second rings of a loose-leaf ring binder. Increasing the size of the first loop decreases the size of the second loop, and increasing the size of the second loop decreases the size of the first loop.

A third expression of a preferred embodiment of the invention is for a storage pouch having a pouch body and a cord. The pouch body has a substantially textbook size and shape, has a top and a bottom, and has first and second sides. The pouch body also has opposing front and back covers joined together at the top and at the bottom and at the first and second sides to enclose an interior cavity. The pouch body has an opening in communication with the interior cavity. The cord, when non-flexed, lies substantially in a plane. The cord is attached to the pouch body and has variable-size first and second loops disposed outside the pouch body. The first loop is located along the first side proximate the top and the second loop is located along the first side proximate the bottom. Increasing the size of the first loop decreases the size of the second loop, and increasing the size of the second loop decreases the size of the first loop.

Several benefits and advantages are derived from the invention. The design of the preferred embodiment of the storage pouch of the invention allows a user to store articles such as school pencils, pens, erasers, and calculators in the interior cavity of the pouch body. In a first utilization mode, the user stacks and transports the textbook sized and shaped storage pouch with school textbooks. In a second utilization mode, the user attaches the storage pouch to the rings of a loose-leaf ring binder so that the ring binder holds both paper and the storage pouch. Attachment to the ring binder is accomplished by pulling on the first or second loop to make the two loops substantially the same size, and then placing the two loops over two of the rings of the ring binder. In a third utilization mode, the user hangs the storage pouch on a hook, wherein the hook diameter is larger than the ring diameter. Attachment to the hook is accomplished by pulling on the top one of the first and second loops making the top loop larger, and then placing the enlarged top loop over the hook.

DETAILED DESCRIPTION

Figure 1:
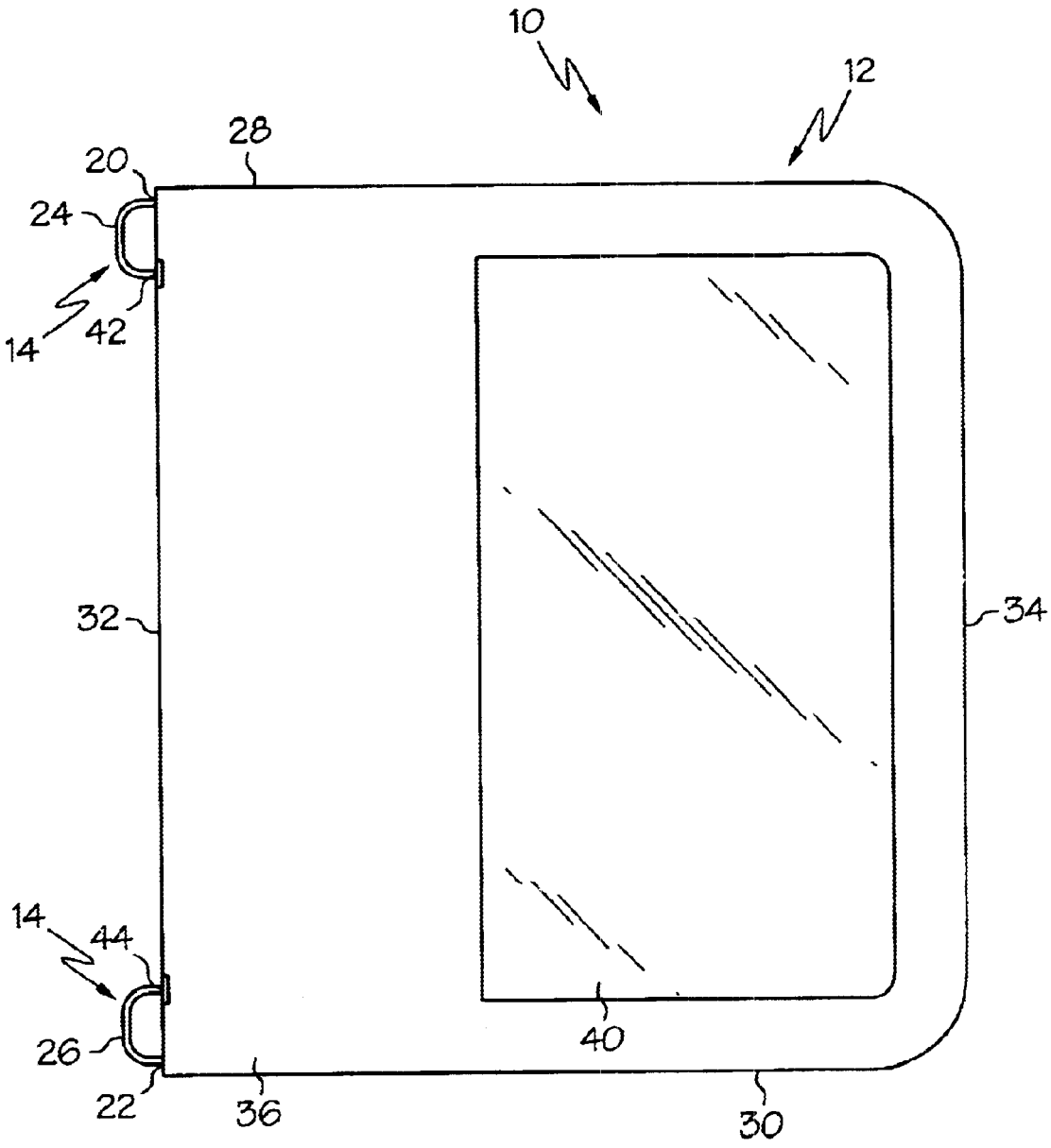
FIG. 1 is a schematic, front elevational view of a preferred embodiment of a storage pouch of the invention with the first and second loops ready for attachment to the rings of a loose-leaf ring binder.
Figure 2:
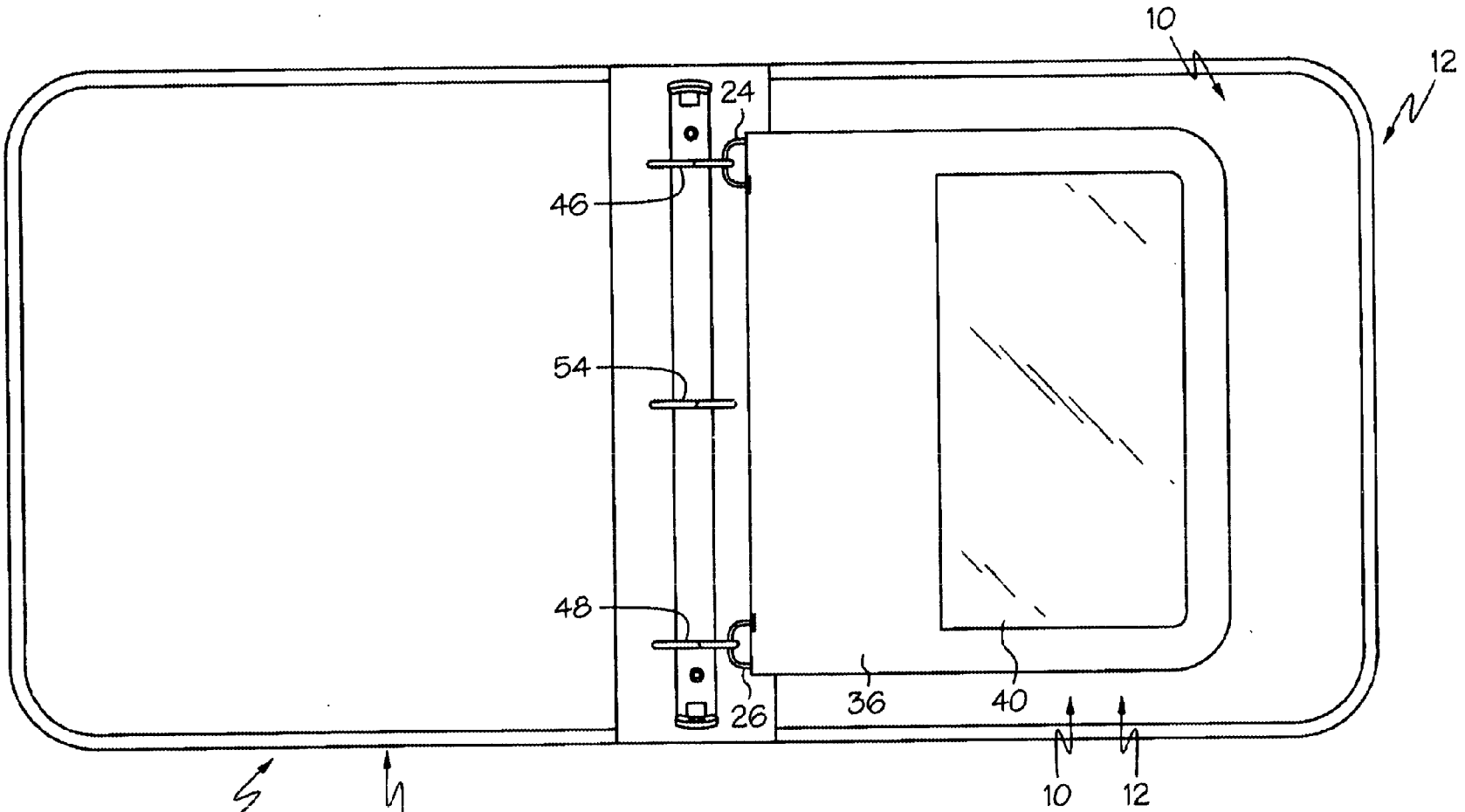
FIG. 2 is a schematic, front elevational view of the storage pouch of FIG. 1 installed in a loose-leaf ring binder.
Figure 3:
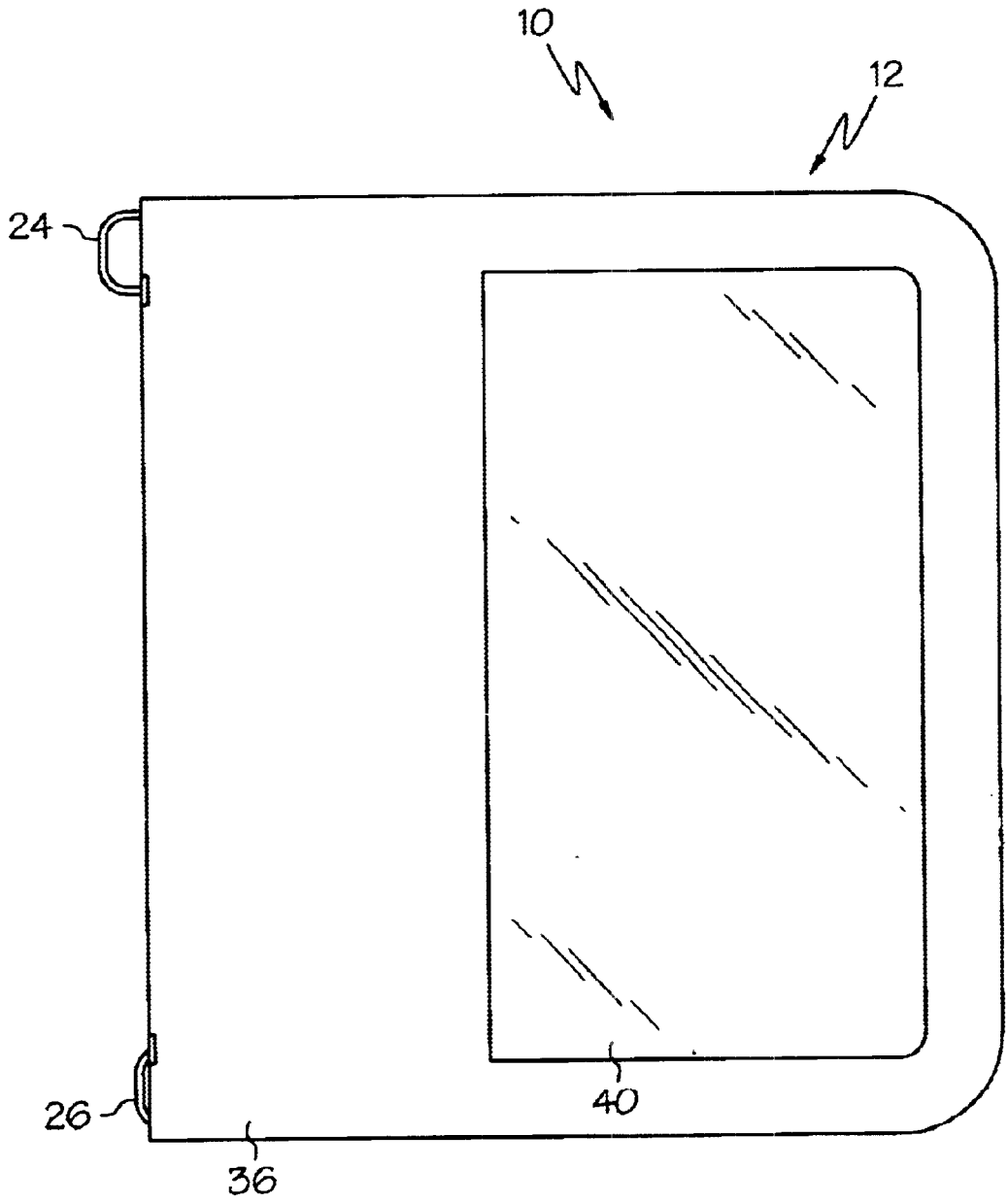
FIG. 3 is a view, as in FIG. 1, but with the cord at the first loop pulled to make the first loop larger and to make the second loop smaller.
Figure 4:
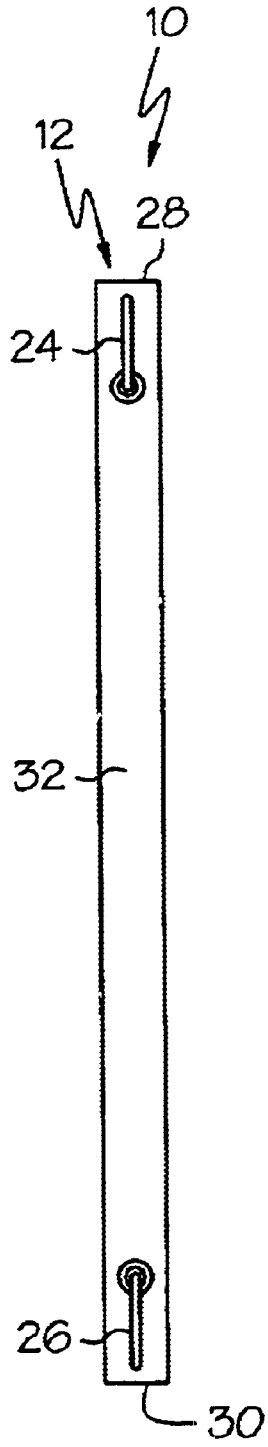
FIG. 4 is a side elevational view of the first side of the storage pouch of FIG. 1.
Figure 5:
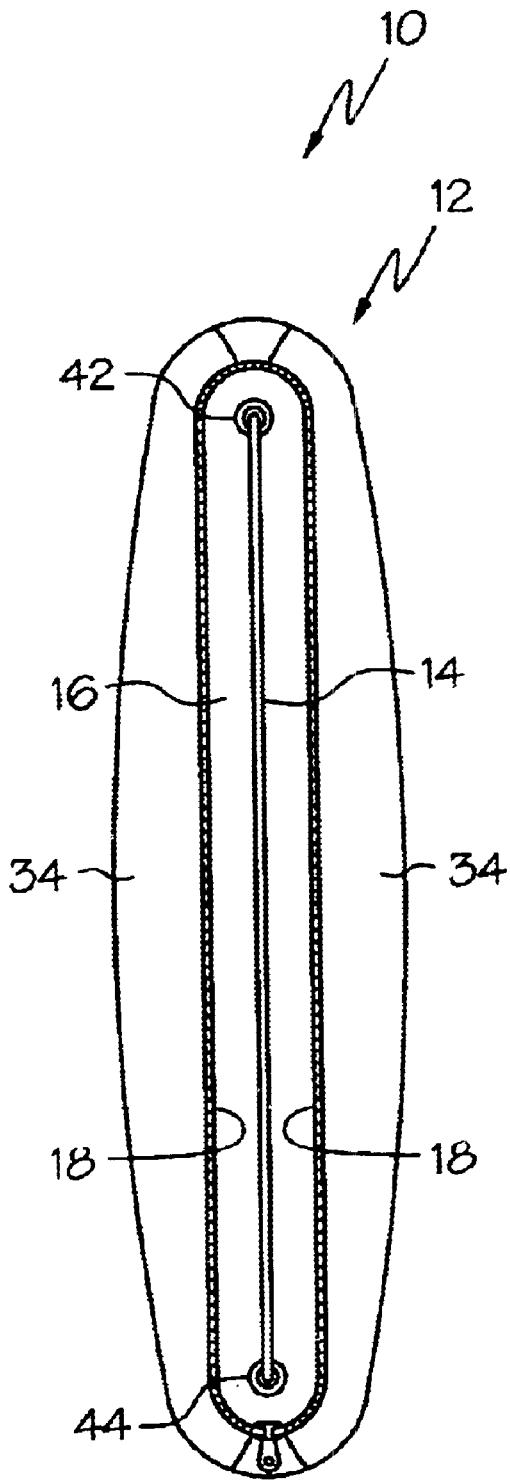
FIG. 5 is a side elevational view of the second side of the storage pouch of FIG. 1 showing the opened zippered opening of the pouch body and the interior cavity of the storage pouch.
Figure 6:
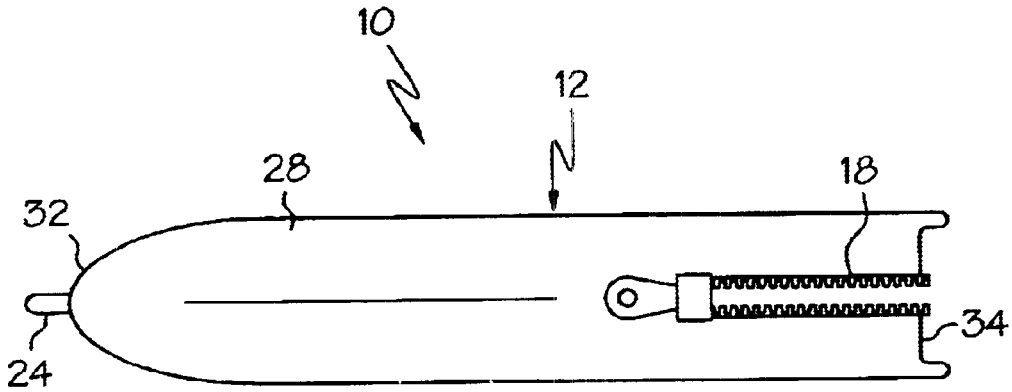
FIG. 6 is a top planar view of the storage pouch of FIG. 1 showing the closed zippered opening.
Figure 7:
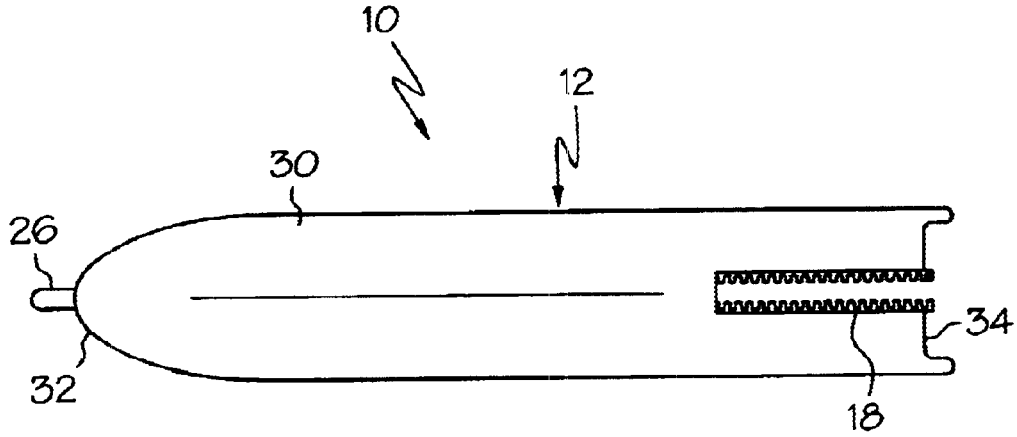
FIG. 7 is a bottom planar view of the storage pouch of FIG. 1 showing the closed zippered opening.

A preferred embodiment of the invention is for a storage pouch 10 and is shown in FIGS. 1–6. In a first expression of the preferred embodiment of the invention shown in the figures, the storage pouch 10 includes a pouch body 12 and a cord 14. The pouch body 12 encloses an interior cavity 16, and the pouch body 12 has an opening 18 in communication with the interior cavity 16. The cord 14 is attached to the pouch body 12 and has variable-size first and second loops 24 and 26 disposed outside the pouch body 12. Increasing the size of the first loop 24 decreases the size of the second loop 26, and increasing the size of the second loop 26 decreases the size of the first loop 24.

Preferably, the pouch body 12 has a top 28 and a bottom 30, has first and second sides 32 and 34, and has opposing front and back covers 36 and 38. The front and back covers 36 and 38 are joined together at the top 28 and at the bottom 30 and at the first and second sides 32 and 34 to enclose the interior cavity 16. The first loop 24 preferably is disposed along the first side 32 proximate the top 28, and the second loop 26 preferably is disposed along the first side 32 proximate the bottom 30. By "proximate" is meant that the first loop 24 is spaced a distance from the top 28 which is smaller than the pouch distance the first loop 24 spans as measured along the first side 32, and that the second loop 26 is spaced a distance from the bottom 30 which is smaller than the pouch distance the second loop 26 spans as measured along the first side 32.

In one example, the cord 14, when non-flexed, lies substantially in a plane. This means that the plane also substantially contains the first and second loops 24 and 26, when non-flexed. In another example, the top 28, the bottom 30, and the second side 34 are gusseted, and the first side 32 is non-gusseted. In a further example, at least one of the front and back covers 36 and 38 includes a see-through portion 40.

Preferably, the front and back covers 36 and 38 each have a shape of substantially a rectangle. It is also preferred that the top 28 and the bottom 30 are spaced apart by a first distance, the first and second sides 32 and 34 are spaced or apart by a second distance, and the first distance is greater than the second distance. It is further preferred that the pouch body 12 have a substantially textbook size and shape.

In one design, the first side 32 has first and second through holes 42 and 44. Here, the first loop 24 passes through the first through hole 42, the second loop 26 passes through the second through hole 44, and the cord 14 between the first and second loops 24 and 26 is disposed in the interior cavity 16. In another design, the first and second loops 24 and 26 are spaced a distance apart so as to be attachable, respectively, to first and second rings 46 and 48 of a loose-leaf ring binder 50.

Preferably, the opening 18 is a closable opening disposed along the second side 34. It is also preferred that the closable opening extend partially along the top 28 and partially along the bottom 30. It is further preferred that closable opening is a zippered opening. In one example, the zippered opening is disposed closer to the front cover 36 than to the back cover 38, and preferably the zippered opening is disposed substantially adjacent the front cover 36.

There are numerous constructions (or ways) to attach the cord 14 to the pouch body 12. In one construction, the cord 14 has first and second ends 20 and 22 attached to the pouch body 12 external of the interior cavity 16. In a second construction (not shown), the first end 20 passes through an additional hole in the pouch body 12 and is knotted inside the interior cavity 16, and the second end 22 passes through a further hole in the pouch body 12 and is knotted inside the interior cavity 16. In a third construction (not shown), the first and second ends 20 and 22 of the cord 14 of the just-described second construction are not individually knotted but are tied or otherwise secured together. In a fourth construction (not shown), the entire cord 14 is disposed on the outside of the pouch body 12 with first and second external eyelets (secured to the pouch body 12) replacing the first and second through holes 42 and 44, with the first end 20 either attached to the pouch body 12 or passing through an additional external eyelet and either being knotted or tied (or otherwise secured) to the second end 22, and with the second end 22 either attached to the pouch body 12 or passing through a further external eyelet and either being knotted or tied (or otherwise secured) to the first end 20. It is noted that the locations of the first end 20 and the first through hole 42 can exchanged, and the locations of the second end 22 and the second through hole 44 can be exchanged. Likewise, the locations of the replacement external eyelets and the additional and further external eyelets can be exchanged. Other constructions (or ways) to attach the cord 14 to the pouch body 12 and other arrangements to provide the first and second loops 24 and 26 are left to the artisan. In one example, the first and second through holes 42 and 44 are grommeted through holes.

In a second expression of the preferred embodiment of the invention shown in the figures, the storage pouch 10 includes a pouch body 12 and a cord 14, The pouch body 12 has a substantially textbook size and shape, encloses an interior cavity 16, and has an opening 18 in communication with the interior cavity 16. The cord 14 is attached to the pouch body 12 and has variable-size first and second loops 24 and 26 which are disposed outside the pouch body 12. The first a and second loops 24 and 26 are spaced apart a distance so as to be attachable, respectively, to first and second rings 46 and 48 of a loose-leaf ring binder 50. Increasing the size of the first loop 24 decreases the size of the second loop 26, and increasing the size of the second loop 26 decreases the size of the first loop 24.

Preferably, the cord 14 between the first and second loops 24 and 26 is disposed in the interior cavity 16. It is also preferred that the opening 18 is a closable opening. It is further preferred that the closable opening is a zippered opening.

Alternatively, the preferred embodiment of the invention shown in the figures is expressed as a loose-leaf ring binder and storage pouch assembly 52 and is otherwise identical to the previously-described second expression of the preferred embodiment of the invention shown in the figures but with the first and second loops 24 and 26 described as being attached, respectively to the first and second rings 46 and 48 of the loose-leaf ring binder 50. It is noted that the ring binder 50 is not limited to two rings, and in one design includes a third ring 54. It is also noted that the storage pouch 10 is not limited to two loops and in one design includes a third loop (not shown) for attachment to the third ring 54. Other designs include additional loops (not shown).

In a third expression of the preferred embodiment of the invention shown in the figures, the storage pouch 10 includes a pouch body 12 and a cord 14. The pouch body 12 has a substantially textbook size and shape, has a top 28 and a bottom 30, and has first and second sides 32 and 34. The pouch body 12 also has opposing front and back covers 36 and 38 joined together at the top 28 and at the bottom 30 and at the first and second sides 32 and 34 to enclose an interior cavity 16. The pouch body 12 has an opening 18 in communication with the interior cavity 16. The cord 14 has first and second ends 20 and 22 attached to the pouch body 12. The cord 14, when non-flexed, lies substantially in a plane. The cord 14 is attached to the pouch body 12 and has variable-size first and second loops 24 and 26 disposed outside the pouch body 12. The first loop 24 is disposed along the first side 32 proximate the top 28, and the second loop 26 is disposed along the first side 32 proximate the bottom 30. Increasing the size of the first loop 24 pulls the cord 14 through the first and second through holes 42 and 44 and decreases the size of the second loop 26, and increasing the size of the second loop 26 likewise decreases the size of the first loop 24.

Preferably, in all expressions of the preferred embodiment of the invention shown in the figures, the pouch body 12 is manually pliable (i.e., pliable in a single hand of an average adult person). In one construction, the pouch body 12 comprises woven nylon fabric, and the cord 14 comprises braided nylon. It is preferred that the pouch body 12 is a hand-holdable pouch body meaning the pouch body may be picked up, and held in, a single hand of an average adult person. Preferably, the opening 18 is the only opening (zippered or not, and closable or not)) of the pouch body 12 which is in communication with the interior cavity 16. In one construction, the top-to-bottom length of the front cover 36 is between generally eight and twelve inches, and the side-to-side width of the front cover 36 is between generally six and ten inches. In one model, the length of the front cover 36 is generally nine and three-quarter inches, and the width of the front cover 36 is generally eight and one-quarter inches. Preferably, the first side 32 of the pouch body 12 has a front-to-back thickness which is generally the sum of the thicknesses of the front and back covers 36 and 38. Preferably, the second side 34 of the pouch body 12, when the second side 34 is a gusseted side which is stretched, has a maximum front-to-back thickness of between generally one and three inches, and preferably has a maximum thickness equal to generally two inches.

In one construction, the see-through portion 40 is a sheet of a substantially transparent material such as plastic. In another construction, the see-through portion 40 is a mesh, such as a nylon mesh, having spaced-apart strands creating openings small enough to contain articles intended for storage in the interior cavity of the pouch body but large enough to permit visual identification of such articles. Preferably, the see-through portion 40 covers a majority of the front and/or back cover 36 and 38.

Several benefits and advantages are derived from the invention. The design of the preferred embodiment of the storage pouch of the invention allows a user to store articles such as school pencils, pens, erasers, and calculators in the interior cavity of the pouch body. In a first utilization mode, the user stacks and transports the textbook sized and shaped storage pouch with school textbooks. In a second utilization mode, the user attaches the storage pouch to the rings of a loose-leaf ring binder so that the ring binder holds both paper and the storage pouch. Attachment to the ring binder is accomplished by pulling on the first or second loop to make the two loops substantially the same size, and then placing the two loops over two of the rings of the ring binder. In a third utilization mode, the user hangs the storage pouch on a hook, wherein the hook diameter is larger than the ring diameter. Attachment to the hook is accomplished by pulling on the top one of the first and second loops making the top loop larger, and then placing the enlarged top loop over the hook.

The foregoing description of several expressions of a preferred embodiment of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

What is claimed is:

1. A storage pouch comprising a pouch body and a cord, wherein the pouch body encloses an interior cavity and has an opening in communication with the interior cavity, wherein the cord is attached to the pouch body and has variable-size first and second loops disposed outside the pouch body, wherein increasing the size of the first loop decreases the size of the second loop, wherein increasing the size of the second loop decreases the size of the first loop, wherein the opening is disposed on the pouch body elsewhere than between the first and second loops, and wherein the pouch body is devoid of any orifice which is in communication with the interior cavity, which is not passed through by a portion of the cord, and which is disposed between the first and second loops.

2. The storage pouch of claim 1, wherein the first and second loops are spaced a distance apart so as to be attachable, respectively, to first and second rings of a loose-leaf ring binder.

3. The storage pouch of claim 1, wherein the pouch body has a top and a bottom, has first and second sides, and has opposing front and back covers joined together at the top and at the bottom and at the first and second sides to enclose the interior cavity, wherein the first loop is disposed along the first side proximate the top, and wherein the second loop is disposed along the first side proximate the bottom.

4. The storage pouch of claim 3, wherein the cord, when non-flexed, lies substantially in a plane.

5. The storage pouch of claim 3, wherein the top, the bottom, and the second side are gusseted, and wherein the first side is non-gusseted.

6. The storage pouch of claim 3, wherein at least one of the front and back covers includes a see-through portion.

7. The storage pouch of claim 3, wherein the front and back covers each have a shape of substantially a rectangle.

8. The storage pouch of claim 7, wherein the top and the bottom are spaced apart by a first distance, wherein the first and second sides are spaced apart by a second distance, and wherein the first distance is greater than the second distance.

9. The storage pouch of claim 8, wherein the pouch body has a substantially textbook size and shape.

10. The storage pouch of claim 3, wherein the first side has first and second through holes, wherein the first loop passes through the first through hole, wherein the second loop passes through the second through hole, and wherein the cord between the first and second loops is disposed entirely in the interior cavity.

11. The storage pouch of claim 10, wherein the first and second through holes are grommeted through holes.

12. The storage pouch of claim 3, wherein the opening is a closable opening disposed along the second side.

13. The storage pouch of claim 12, wherein the closable opening is a zippered opening.

14. A storage pouch comprising a pouch body and a cord, wherein the pouch body encloses an interior cavity and has an opening in communication with the interior cavity, wherein the cord is attached to the pouch body and has variable-size first and second loops disposed outside the pouch body, wherein increasing the size of the first loop decreases the size of the second loop, wherein increasing the size of the second loop decreases the size of the first loop, wherein the pouch body has a top and a bottom, has first and second sides, and has opposing front and back covers joined together at the top and at the bottom and at the first and second sides to enclose the interior cavity, wherein the first loop is disposed along the first side proximate the top, wherein the second loop is disposed along the first side proximate the bottom, wherein the opening is a closable opening disposed along the second side, wherein the closable opening extends partially along the top and partially along the bottom, and wherein the pouch body is devoid of any orifice which is in communication with the interior cavity, which is not passed through by a portion of the cord, and which is disposed along the first side.

15. A storage pouch comprising a pouch body and a cord, wherein the pouch body encloses an interior cavity and has an opening in communication with the interior cavity, wherein the cord is attached to the pouch body and has variable-size first and second loops disposed outside the pouch body, wherein increasing the size of the first loop decreases the size of the second loop, wherein increasing the size of the second loop decreases the size of the first loop, wherein the cord has first and second ends attached to the pouch body external of the interior cavity, and wherein the pouch body is devoid of any orifice which is in communication with the interior cavity, which is not passed through by a portion of the cord, and which is disposed between the first and second loops.

16. A storage pouch comprising a pouch body and a cord, wherein the pouch body has a substantially textbook size and shape, encloses an interior cavity, and has an opening in communication with the interior cavity, wherein the cord is attached to the pouch body and has variable-size first and second loops which are disposed outside the ouch body and which are spaced apart a distance so as to be attachable, respectively, to first and second rings of a loose-leaf ring binder, wherein increasing the size of the first loop decreases the size of the second loop, wherein increasing the size of the second loop decreases the size of the first loop, wherein the opening is disposed on the pouch body elsewhere than between the first and second loops, and wherein the pouch body is devoid of any orifice which is in communication with the interior cavity, which is not passed through by a portion of the cord, and which is disposed between the first and second loops.

17. The storage pouch of claim 16, wherein the cord between the first and second loops is disposed entirely in the interior cavity.

18. The storage pouch of claim 16, wherein the opening is a closable opening.

19. The storage pouch of claim 18, wherein the closable opening is a zippered opening.

20. A storage pouch comprising a pouch body and a cord, wherein the pouch body has a substantially textbook size and shape, has a top and a bottom, has first and second sides, and has opposing front and back covers joined together at the top and at the bottom and at the first and second sides to enclose an interior cavity, wherein the pouch body has an opening in communication with the interior cavity, wherein the cord, when non-flexed, lies substantially in a plane, wherein the cord is attached to the pouch body and has variable-size first and second loops disposed outside the pouch body, wherein the first loop is disposed along the first side proximate the top, wherein the second loop is disposed along the first side proximate the bottom, wherein increasing the size of the first loop decreases the size of the second loop, wherein increasing the size of the second loop decreases the size of the first loop, wherein the opening is disposed on the second side, and wherein the pouch body is devoid of any orifice which is in communication with the interior cavity, which is not passed through by a portion of the cord, and which is disposed along the first side.

21. A loose-leaf ring binder and storage pouch assembly comprising a loose-leaf ring binder and a storage pouch, wherein the loose-leaf ring binder has first and second rings, wherein the storage pouch has a pouch body and a cord, wherein the pouch body has a substantially textbook size and shape, encloses an interior cavity, and has an opening in communication with the interior cavity, wherein the cord is attached to the pouch body and has variable-size first and second loops which are disposed outside the pouch body and which are spaced apart a distance and are attached, respectively, to the first and second rings of the loose-leaf ring binder, wherein increasing the size of the first loop decreases the size of the second loop, wherein increasing the size of the second loop decreases the size of the first loop, wherein the opening is disposed on the pouch body elsewhere than between the first and second loops, and wherein the pouch body is devoid of any orifice which is in communication with the interior cavity, which is not passed through by a portion of the cord, and which is disposed between the first and second loops.

22. The storage pouch of claim 21, wherein the cord has first and second ends attached to the pouch body external of the interior cavity.

23. The storage pouch of claim 21, wherein the cord between the first and second loops is disposed in the interior cavity.

24. The storage pouch of claim 21, wherein the opening is a closable opening.

25. The storage pouch of claim 24, wherein the closable opening is a zippered opening.

* * * * *